US007185787B2

(12) United States Patent
Brown et al.

(10) Patent No.: US 7,185,787 B2
(45) Date of Patent: Mar. 6, 2007

(54) TOY WATER GUN SYSTEM WITH DETACHABLE WEAPONS

(75) Inventors: Robert L. Brown, North Kingstown, RI (US); Fred D. Eddins, Mapleville, RI (US)

(73) Assignee: Hasbro, Inc., Pawtucket, RI (US)

( * ) Notice: Subject to any disclaimer, the term of this patent is extended or adjusted under 35 U.S.C. 154(b) by 613 days.

(21) Appl. No.: 10/775,427

(22) Filed: Feb. 10, 2004

(65) Prior Publication Data

US 2005/0173452 A1 Aug. 11, 2005

(51) Int. Cl.
*A63H 3/018* (2006.01)
*A63H 33/03* (2006.01)
*F41A 33/03* (2006.01)

(52) U.S. Cl. ..... 222/79; 446/473; 42/54

(58) Field of Classification Search ..... 222/79, 222/631, 207, 209; 124/59, 63; 417/474; 446/473, 26, 401; 42/54, 55, 57, 58
See application file for complete search history.

(56) References Cited

U.S. PATENT DOCUMENTS 3,878,639 A 4/1975 Scheelar et al.
4,854,480 A 8/1989 Shindo
5,018,449 A 5/1991 Eidson, II
5,074,437 A 12/1991 D'Andrade et al.
5,240,450 A 8/1993 Graham
5,305,919 A 4/1994 Johnson et al.
5,354,225 A 10/1994 Hix
5,433,646 A 7/1995 Tarng
5,515,837 A 5/1996 Nin et al.
5,529,525 A 6/1996 Deal
5,531,627 A 7/1996 Deal
5,538,457 A 7/1996 Deal
6,193,107 B1 2/2001 D'Andrade
6,279,562 B1 8/2001 Clayton
6,631,830 B2 10/2003 Ma et al.

*Primary Examiner*—Kevin Shaver
*Assistant Examiner*—Malvin A. Cartagena
(74) *Attorney, Agent, or Firm*—Marshall, Gerstein & Borun LLP

(57) ABSTRACT

A toy water gun system includes a primary water gun having a housing, a pressurizable reservoir, an outlet nozzle in flow communication with the reservoir, and an actuating trigger, with the primary toy water gun adapted to discharge an output stream of water through the outlet nozzle in response to actuation of the trigger. The housing includes a first receiving area and a second receiving area, with each receiving area having an output port in flow communication with the reservoir via a conduit, a pair of valves to control flow through the conduits. A first detachable water toy mounts to the housing at the first receiving area and receives water from the reservoir, and a second detachable water toy mounts to the housing at the second receiving area. The first and second detachable water toys are selectively removable from the primary water toy for use.

24 Claims, 14 Drawing Sheets

TOY WATER GUN SYSTEM WITH DETACHABLE WEAPONS

BACKGROUND OF THE INVENTION

The present invention relates generally to a toy water squirt gun and, more particularly, to a pressurized toy water squirt gun having a primary squirt gun and one or more detachable water weapons.

Pressurized squirt guns that eject water from a pressurized reservoir are generally known in the art. For example, U.S. Pat. No. 5,074,437 to D'Andrade et al. discloses a toy water gun that operates by releasing water from a water reservoir that is pressurized by air. The reservoir is pressurized using a manually operated air pump. When a trigger is operated, water is released under pressure from the reservoir through an outlet nozzle.

A number of additional water-based toy guns or other water-based toy weapons exist in the prior art. For example, U.S. Pat. No. 4,854,480 to Shindo discloses a squirt gun having a hollow housing and having an expandable rubber tube disposed within the hollow housing. A trigger squeezes or pinches a portion of the rubber tube against the housing to close off an outlet nozzle. Pressurized water is released from the rubber tube upon rotating the trigger, which releases the squeezed portion of the tube so that water may be dispensed from the outlet nozzle. Another water-based toy weapon can be found in U.S. Pat. No. 5,354,225 to Hix, which discloses a toy water grenade. A housing includes a fluid chamber surrounded by a pneumatic chamber. A piston member is arranged for sliding movement along the reservoir chamber upon release of a pin. Upon movement of the piston, exit ports are exposed and water is expelled from the fluid chamber.

SUMMARY OF THE INVENTION

In one aspect, the invention is directed to a toy water gun system comprising a primary water gun having a housing, a pressurizable reservoir, an outlet nozzle in flow communication with the reservoir, and an actuating trigger, with the primary toy water gun adapted to discharge an output stream of water through the outlet nozzle in response to actuation of the trigger. The housing of the primary water gun includes a first receiving area and a second receiving area, each of the first and second receiving areas having an output port, the output port of the first receiving area in flow communication with the reservoir via a first conduit, the output port of the second receiving area in flow communication with the reservoir via a second conduit. A first valve is positioned to control flow through the first conduit, and a second valve is positioned to control flow through the second conduit. A first detachable water toy is sized for mounting to the housing at the first receiving area and is arranged to receive water from the reservoir via the output port of the first receiving area in response to operation of the first valve. A second detachable water toy is sized for mounting to the housing at the second receiving area and is arranged to receive water from the reservoir via the output port of the second receiving area in response to operation of the second valve. The first and second detachable water toys are selectively removable from the primary water gun for use.

In further accordance with a preferred embodiment, the first detachable water toy includes a pressurizable reservoir, an outlet nozzle in communication with the reservoir, and an actuating trigger, with the first detachable water toy adapted to discharge an output stream of water through the outlet nozzle of the first detachable water toy in response to actuation of the trigger of the first detachable water toy. The first receiving area may include a spring-loaded plunger positioned to releasably retained the first detachable water toy in the first receiving area. Still preferably, the first detachable water toy includes an inlet port positioned to receive water from the output port of the first receiving area, and the spring-loaded plunger is adapted to maintain the inlet port of the first water toy in flow communication with the output port of the first receiving area when the first detectable water toy is disposed in the first receiving area.

The second detachable water toy may comprise a sponge, and the sponge may be throwable. Preferably, the second receiving area may include a first panel disposed adjacent the output port of the first receiving area and a second panel spaced away from the first panel, with the first and second panels cooperating to releasably retain the second detachable water toy in the second receiving area. The first and second panels may be shaped to correspond to the shape of the second detachable water toy.

The first and second valves may be spring-loaded, and the trigger of the primary water gun may be slidably mounted to the housing. The primary water gun may include a primary valve disposed adjacent the outlet nozzle, the primary valve operatively connected to trigger by a connecting rod.

In another aspect of the invention, a primary water gun includes a housing, a reservoir, an outlet nozzle in flow communication with the reservoir, an actuating trigger, and an outlet valve disposed adjacent the outlet nozzle and responsive to actuation of the trigger, with the primary toy water gun adapted to discharge an output stream of water through the outlet nozzle in response to actuation of the trigger. The housing of the primary water gun further includes a first receiving area and a second receiving area, with each of the first and second receiving areas having an output port. The output port of the first receiving area is in flow communication with the reservoir via a first conduit, and the output port of the second receiving area is in flow communication with the reservoir via a second conduit. A first valve is positioned to control flow through the first conduit, and a second valve is positioned to control flow through the second conduit. A first detachable water toy is removably attached to the first receiving area and includes an expandable bladder, a nozzle in communication with the bladder, and an actuating trigger, with the first detachable water toy adapted to discharge an output stream of water through the nozzle in response to actuation of the trigger. The bladder of the first detachable water toy is arranged to receive water through the nozzle from the reservoir of the primary water gun via the output port of the first receiving area in response to operation of the first valve. A second detachable water toy is removably attached to the second receiving area, with the second detachable water toy arranged to receive water from the reservoir via the output port of the second receiving area in response to operation of the second valve. Accordingly, the first and second detachable water toys are selectively removable from the primary water gun for use.

In accordance with a still further aspect of the invention, a toy water gun system includes a primary water gun having a housing, a reservoir, an outlet nozzle in flow communication with the reservoir, an actuating trigger, and an outlet valve disposed adjacent the outlet nozzle and responsive to actuation of the trigger. The primary water gun is adapted to discharge an output stream of water through the outlet nozzle in response to actuation of the trigger. The outlet valve includes a trip mechanism shiftable between a first position in which flow through the outlet nozzle is prevented, a second position in which flow through the outlet nozzle is permitted, and a third position different from the first position in which flow through the outlet nozzle is prevented, with the trip mechanism being shiftable between the first, second and third positions in response to movement of the trigger between a first position, a second position, and a third position, respectively. The housing of the primary water gun further includes a first receiving area and a second receiving area, each of the first and second receiving areas having an output port, the output port of the first receiving area in flow communication with the reservoir via a first conduit, the output port of the second receiving area in flow communication with the reservoir via a second conduit. A first valve is positioned to control flow through the first conduit, and a second valve is positioned to control flow through the second conduit. A first detachable water toy is removably attached to the first receiving area and includes an expandable bladder, a nozzle in communication with the bladder, and an actuating trigger, with the first detachable water toy adapted to discharge an output stream of water through the nozzle in response to actuation of the trigger. The bladder of the first detachable water toy is arranged to receive water through the nozzle from the reservoir of the primary water gun via the output port of the first receiving area in response to operation of the first valve. A spring-loaded plunger is positioned to bias at least a portion of the first detachable water toy into engagement with the housing. A second detachable water toy is removably attached to the second receiving area, the second detachable water toy arranged to receive water from the reservoir via the output port of the second receiving area in response to operation of the second valve. The first and second detachable water toys are selectively removable from the primary water gun for use.

In accordance with yet another aspect in the invention, a toy gun system comprises a primary toy gun having a housing, a pressurizable reservoir, a launch station in flow communication with the reservoir, an actuating trigger, and an actuator arranged to release pressure from the reservoir through the launch station, the launch station adapted to hold and release a foam projectile in response to actuation of the actuator. The housing of the primary toy gun further includes a receiving area, the receiving area having an output port in flow communication with the reservoir via a conduit. A valve is positioned to control flow through the first conduit, and a detachable toy gun is removably attached to the first receiving area. The detachable toy gun includes a pressurizable reservoir, a launch station in flow communication with the reservoir, and an actuator arranged to release pressure from the reservoir through the launch station. The launch station is adapted to hold and release a foam projectile in response to actuation of the actuator. The detachable toy including an input port arranged to route pressure from the output port of the receiving are to the reservoir of the detachable toy gun. The detachable toy is selectively operable to launch the foam projectile when the detachable toy is in the receiving area and when the detachable toy is removed from the receiving area.

DETAILED DESCRIPTION OF VARIOUS EMBODIMENTS

Although the following text sets forth a detailed description of an exemplary embodiment of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
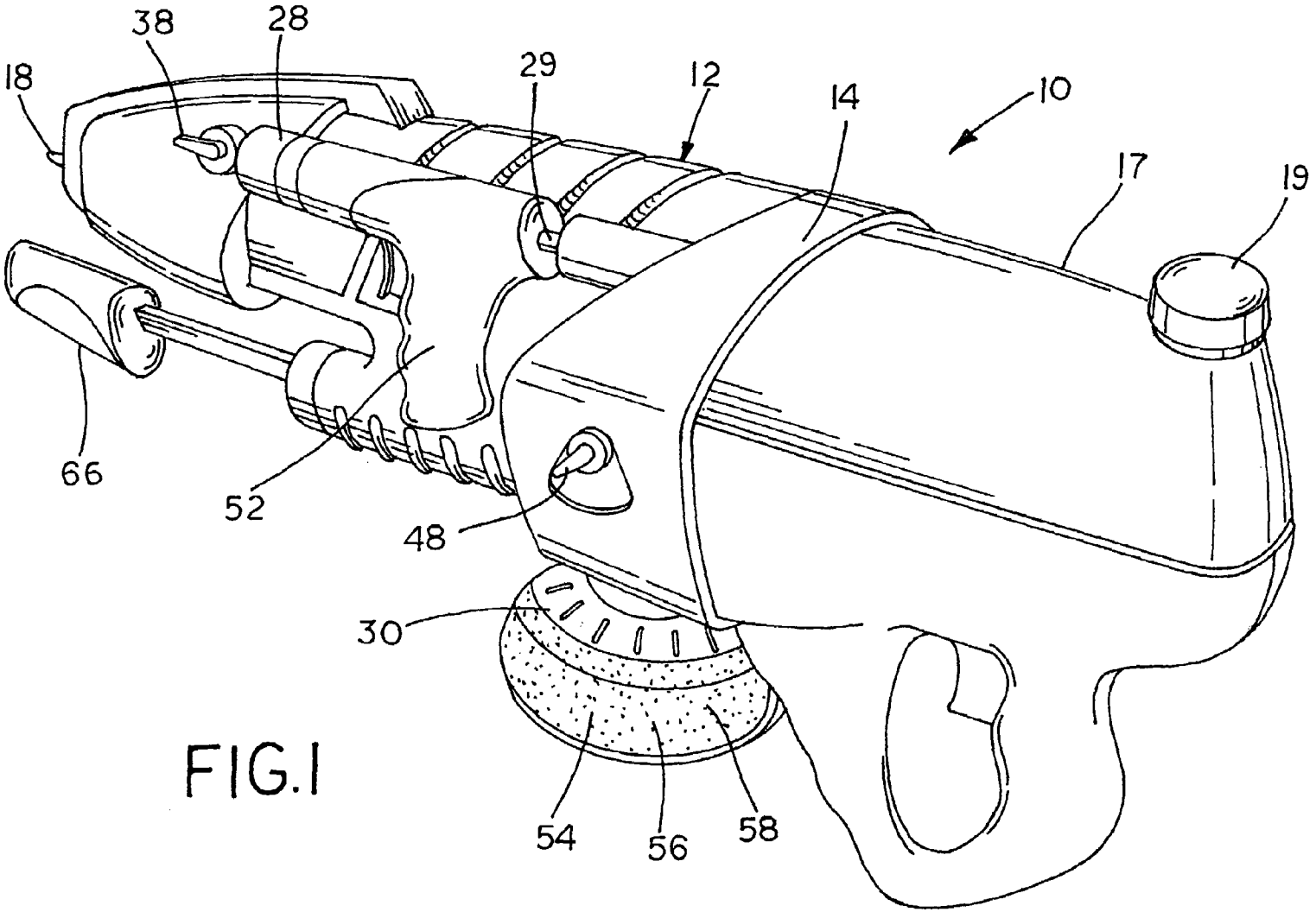
FIG. 1 is a perspective view of a toy water gun system assembled in accordance with the teachings of the present invention.
Figure 2A:
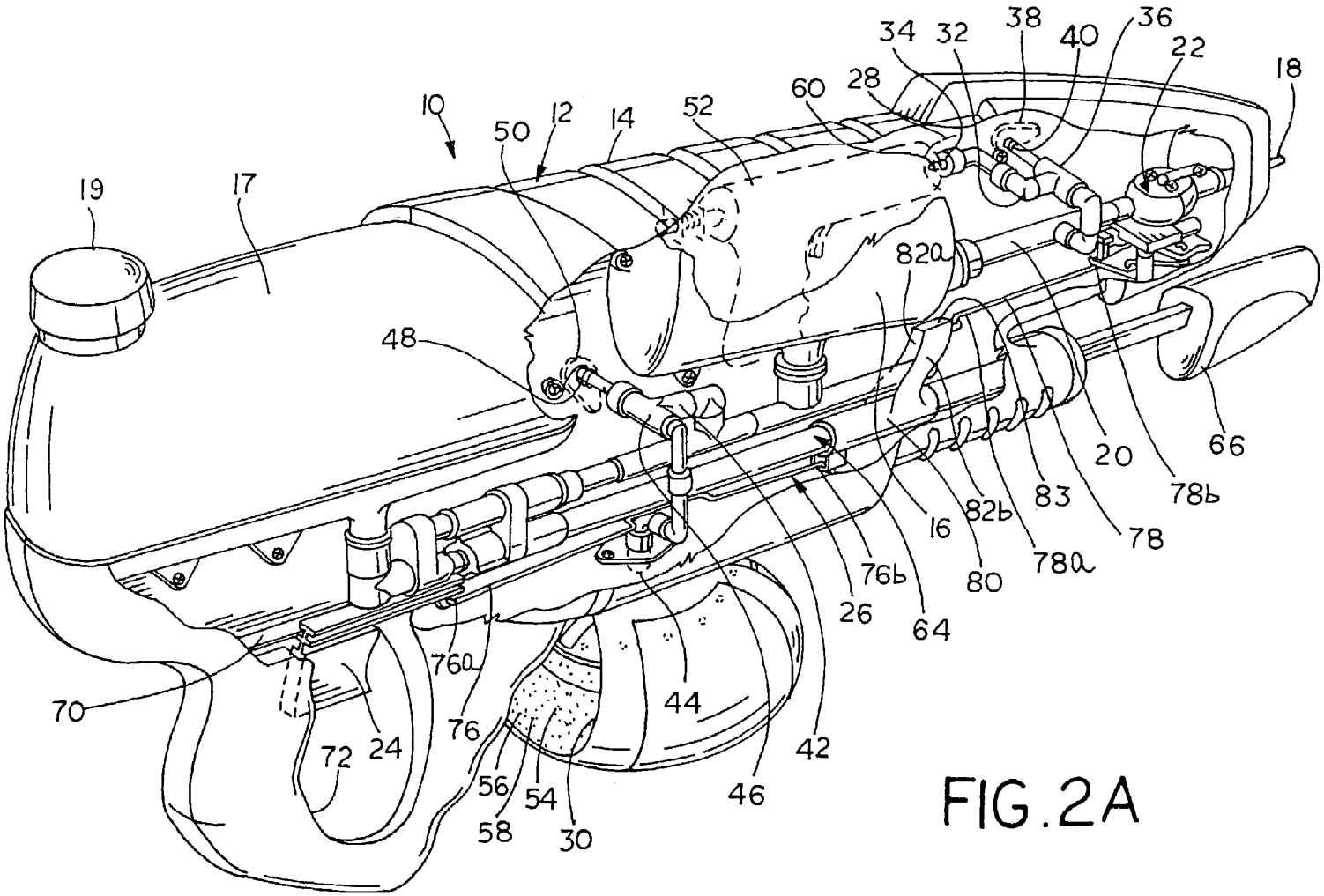
FIG. 2A is a partial cut away view in perspective of the toy water gun system of FIG. 1.
Figure 2B:
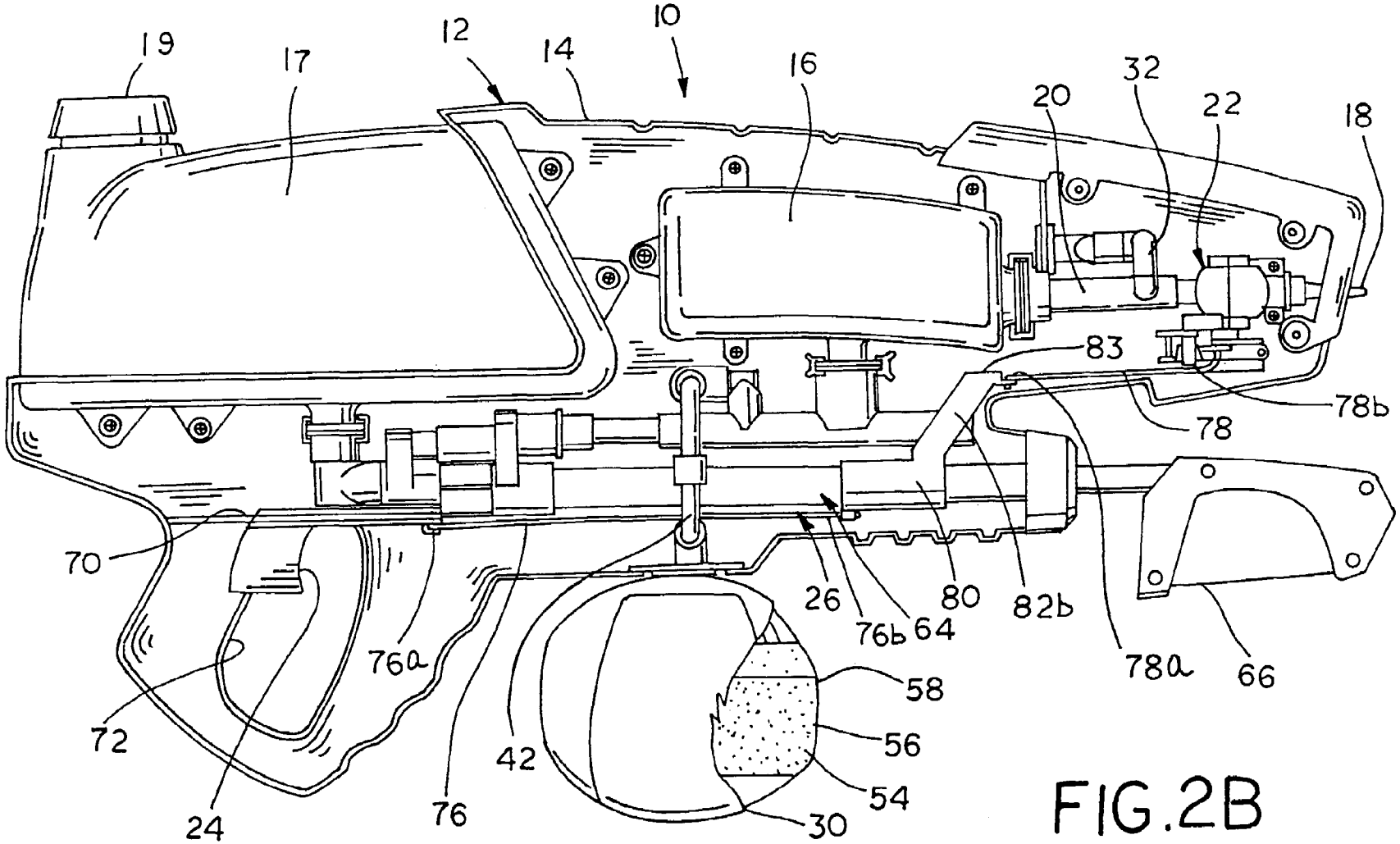
FIG. 2B is a partial cut away elevational view of the toy water gun system shown in FIGS. 1 and 2A.

Referring now to FIGS. 1, 2A and 2B of the drawings, a toy water gun system assembled in accordance with the teachings of the present convention is shown and is generally referred to by the reference numeral 10. The toy water gun system 10 includes a primary water gun 12 having a housing 14 and a reservoir 16 disposed within or otherwise attached or mounted to the housing 14. The reservoir 16 is visible in FIGS. 2A and 2B. Alternatively, the housing 14 may take the form of a frame, or any other suitable structure. The reservoir 16, in accordance with the disclosed example, is preferably pressurizable as will be explained in greater detail below. Also, the primary water gun may include a separate reservoir 17 operatively connected to the reservoir 16 via a system of conduits or other suitable connections as will be described in greater detail below. The reservoir 17 includes a fill cap 19, which is preferably removable to permit filling of the toy gun 12. Other suitable systems of the type known in the art for filling the toy gun may be used, such as those systems that permit the toy gun 12 to be filled by connection to a garden hose.

As shown in FIGS. 2A and 2B, the primary water gun includes an outlet nozzle 18 in flow communication with the reservoir 16 via a conduit 20. A valve assembly 22 is disposed adjacent the outlet nozzle 18 and is operatively connected to a trigger 24 via a linkage 26. As will be explained in greater detail below, when the reservoir 16 is pressurized the primary water gun 12 will eject or shoot a stream of water the from the outlet nozzle 18 in response to operation of the trigger 24.

Referring to FIGS. 1 and 2A, the housing 14 includes a first receiving area 28 and a second receiving area 30. As shown in FIG. 2A, the first receiving area 28 is in flow communication with the reservoir 16 via a conduit 32. The conduit 32 includes an output port 34, and a valve 36 having a switch or handle 38. The valve 36 may be a rotary valve or any other suitable valve. Preferably, a rotary spring 40 is provided adjacent the handle 38 in order to maintain the valve 36 in a closed position.

Similarly, the second receiving area 30 is in flow communication with the reservoir 16 via a conduit 42. The conduit 42 includes an output port 44, and a valve 46 having a switch or handle 48. Again, the valve 46 may be a rotary valve or any other suitable valve. Preferably, a rotary spring 50 is provided adjacent to the handle 48 in order to maintain the valve 46 in a closed position. It will be understood that, upon operation of the valve 36 using the handle 38, that output port 34 may be placed in flow communication with the reservoir 16 via the conduit 32. Similarly, it will be understood that upon operation of the valve 46 using the handle 48, that the output port 44 may be placed in flow communication with the reservoir 16 via the conduit 42.

The toy water gun system 10 further includes a first detachable water toy 52 and a second detachable water toy 54. The first detachable water toy 52, in accordance with the disclosed example, takes the form of a water pistol. The water toy 52 is preferably sized to be releasably mounted to the first receiving area 28 of the primary water gun 12. Similarly, the water toy 54 is preferably sized to be releasably mounted to the second receiving area 30 of the primary water gun 12. The second water toy 54, in accordance with the disclosed example, preferably is constructed of an absorbent material, such as a sponge 56 covered by a water permeable cover 58. Alternatively, both water toys 52 and 54 may be water pistols, both may be absorbent sponges, or one or both may take the form of any other suitable water toy.

The first water toy 52 includes a nozzle 60 (best visible in FIGS. 2A, 5 and 11–12) and an internal reservoir 62 (FIGS. 11 and 12) in flow communication with the nozzle 60. As shown in FIG. 2A, when the water toy 52 is disposed in the first receiving area 28, the nozzle 60 is positioned for flow communication with the output port 34 of the first receiving area 28. Similarly, when the second water toy 54 is disposed in the second receiving area 30, the second water toy (i.e., the sponge 56), is positioned so as to be in flow communication with, or otherwise exposed to, the output port 44 of the second receiving area 30.

Referring to FIGS. 2A and 2B, the reservoir 16 of the primary water gun 12 may be a pressurized toy water squirt gun having a self-contained pressurizing mechanism 64 for pressurizing the reservoir 16 with air, thereby creating a pressure differential between the reservoir 16 and the ambient atmosphere so that water contained in the reservoir 16 may be propelled from the primary toy water gun 12 through the outlet nozzle 18 when the user pulls the trigger 24. The pressurizing mechanism 64 includes a reciprocating pump handle 66, a pair of one way valves 67 and 69, and an over pressure valve 71. As will be explained in greater detail below, in response to operation of the pressurizing mechanism 64 using the handle 66, water contained in the reservoir 17 will be transferred into the reservoir 16. One example of a toy water gun having a pressurizing mechanism for propelling water from a pressurizeable reservoir is illustrated and described in U.S. Pat. No. 5,305,919, entitled "Pinch Trigger Hand Pump Water Gun with Non-Detachable Tank," which issued on Apr. 26, 1994, and which is hereby expressly incorporated by reference herein in its entirety. Of course, other configurations of toy water guns having pressurizing mechanisms for propelling water are well known and will be understood by those skilled in the art.

Referring still to FIGS. 2A and 2B, the valve assembly 22 is disposed within the housing 14 generally adjacent to a forward end 68 of the primary water gun 12. The trigger 24 is preferably slidable on a track 70 disposed within a trigger guard 72 generally adjacent to a rearward end 74 of the primary water gun 12. A portion of the trigger guard 72 may also form a handle for gripping the primary water gun 12, with another handle preferably being provided toward a forward portion of the gun at any suitable location. Instead of a reciprocating trigger, the trigger 24 may be a pivoting trigger or any other trigger suitable for activating the valve assembly 22. The linkage 26 includes a first rod 76 connected to a forward end of the trigger 24, a second rod 78 connected to the valve assembly 22, and a sliding tube 80 operatively connecting the first rod 76 to the second rod 78. The linkage 26 may join the trigger 24 to the valve assembly 22 in any other suitable manner. In the disclosed example, the sliding tube 80 fits over one of the internal conduits of the pressurizing mechanism 64 so as to guide the sliding tube 80 along a generally linear path in response to operation of the trigger 24. In the disclosed example, the tube 80 includes a pair of spaced apart extensions 82*a* and 82*b* which meet at a top end 83. A rear end 78*a* of the rod 78 is attached to the top end 83 of the tube 80. In the disclosed example, the tube 80 straddles another one of the internal conduits, such that the tube 80 slides back and forth without interference from the internal components of the primary water gun 12. Accordingly, operation of the trigger 24 is translated into generally linear movement of the rods 76 and 78 and the tube 80, such that the valve assembly 22 is actuated in response to actuating the trigger 24.

Figure 3:
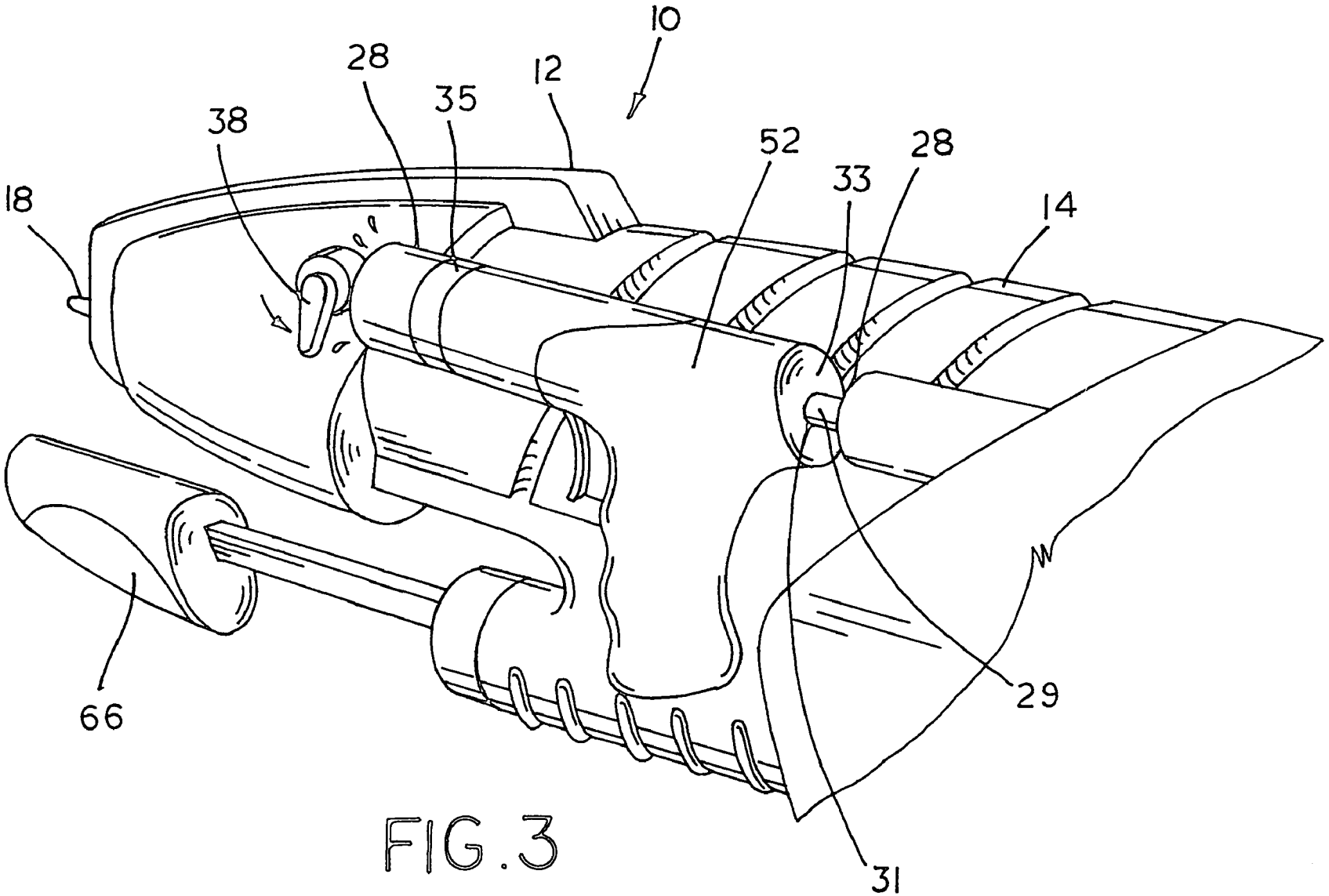
FIG. 3 is an enlarged fragmentary view in perspective of a forward portion of the primary water toy and illustrating a first detachable water toy.
Figure 4:
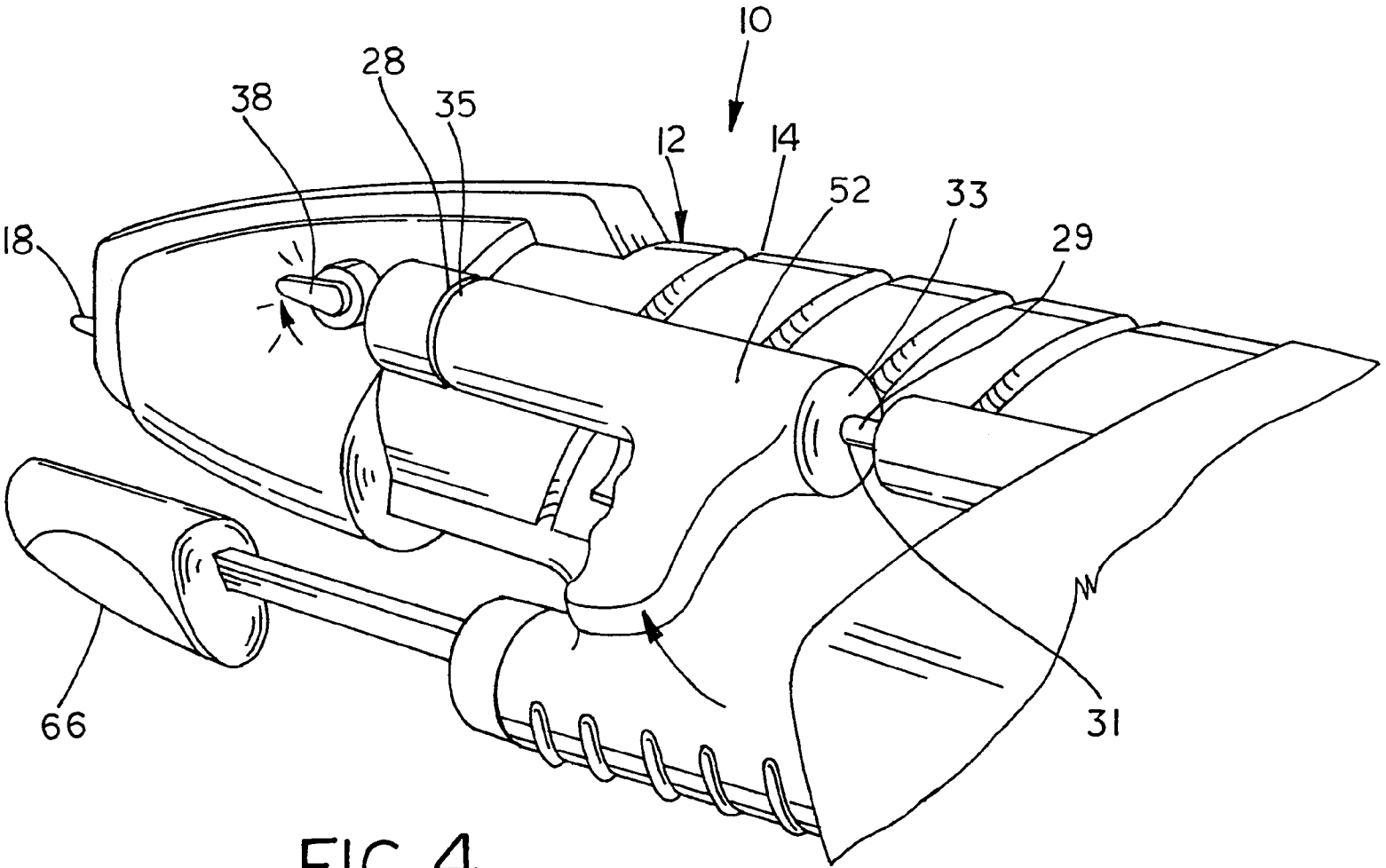
FIG. 4 is an enlarged fragmentary view in perspective similar to FIG. 3 and showing a spring-loaded plunger disposed within a portion of the housing.
Figure 5:
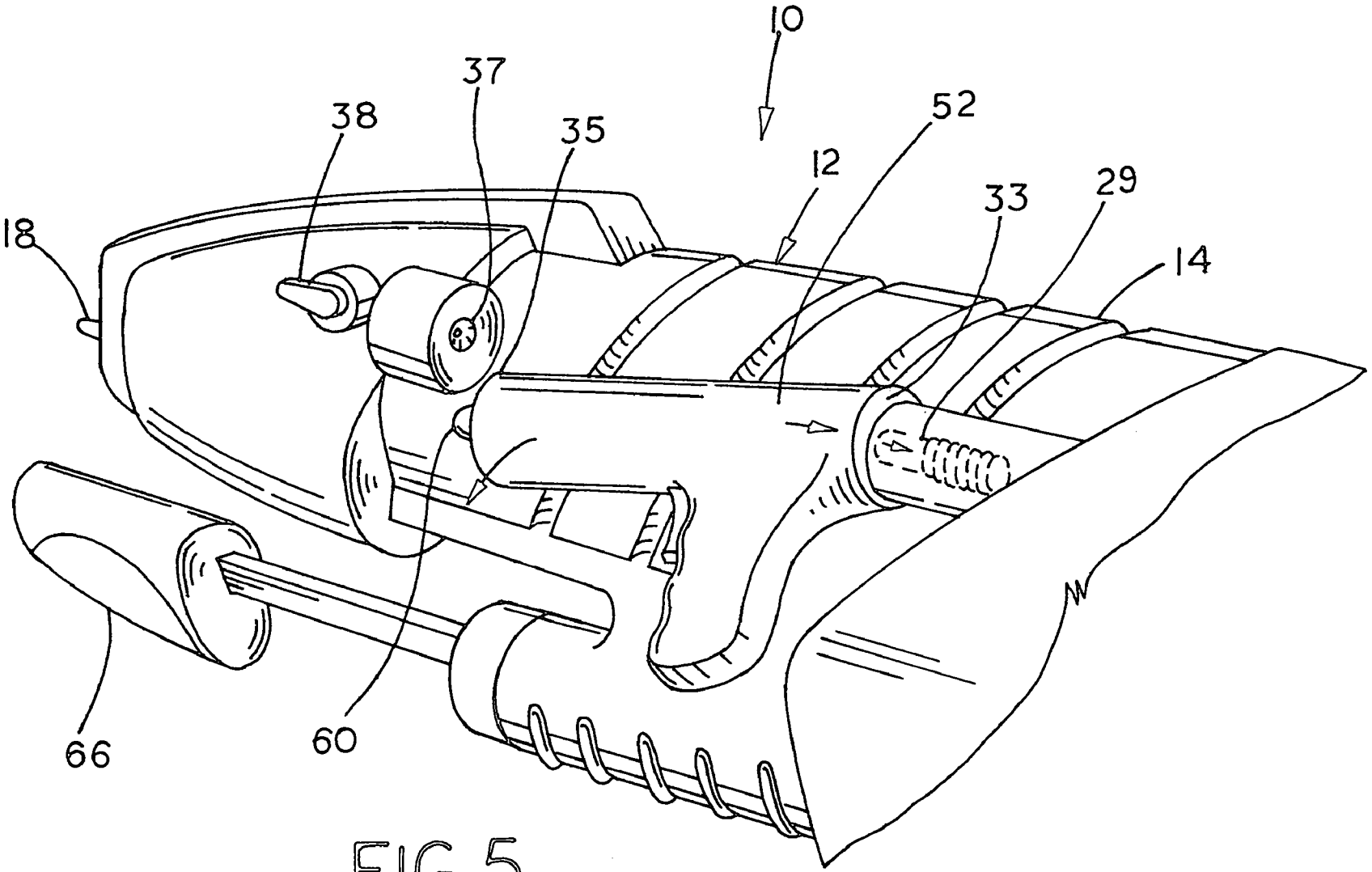
FIG. 5 is an enlarged fragmentary view in perspective similar to FIG. 4 and illustrating one possible manner by which the first detachable water toy may be removed from the primary water toy.

Referring now to FIGS. 3–5, the first water toy 52 is shown disposed in the first receiving area 28. The first receiving area 28 preferably includes a spring-loaded plunger 29 which engages a recess 31 defined in a rearward part 33 of the first water toy 52. As can be seen in FIG. 15, a forward part 35 of the first water toy 52 and/or a tip of the water toy 52 is preferably shaped to be received in a recess 37 defined in the first receiving area 28 generally surrounding or otherwise adjacent to the output port 34 of the first receiving area 28.

Figure 6:
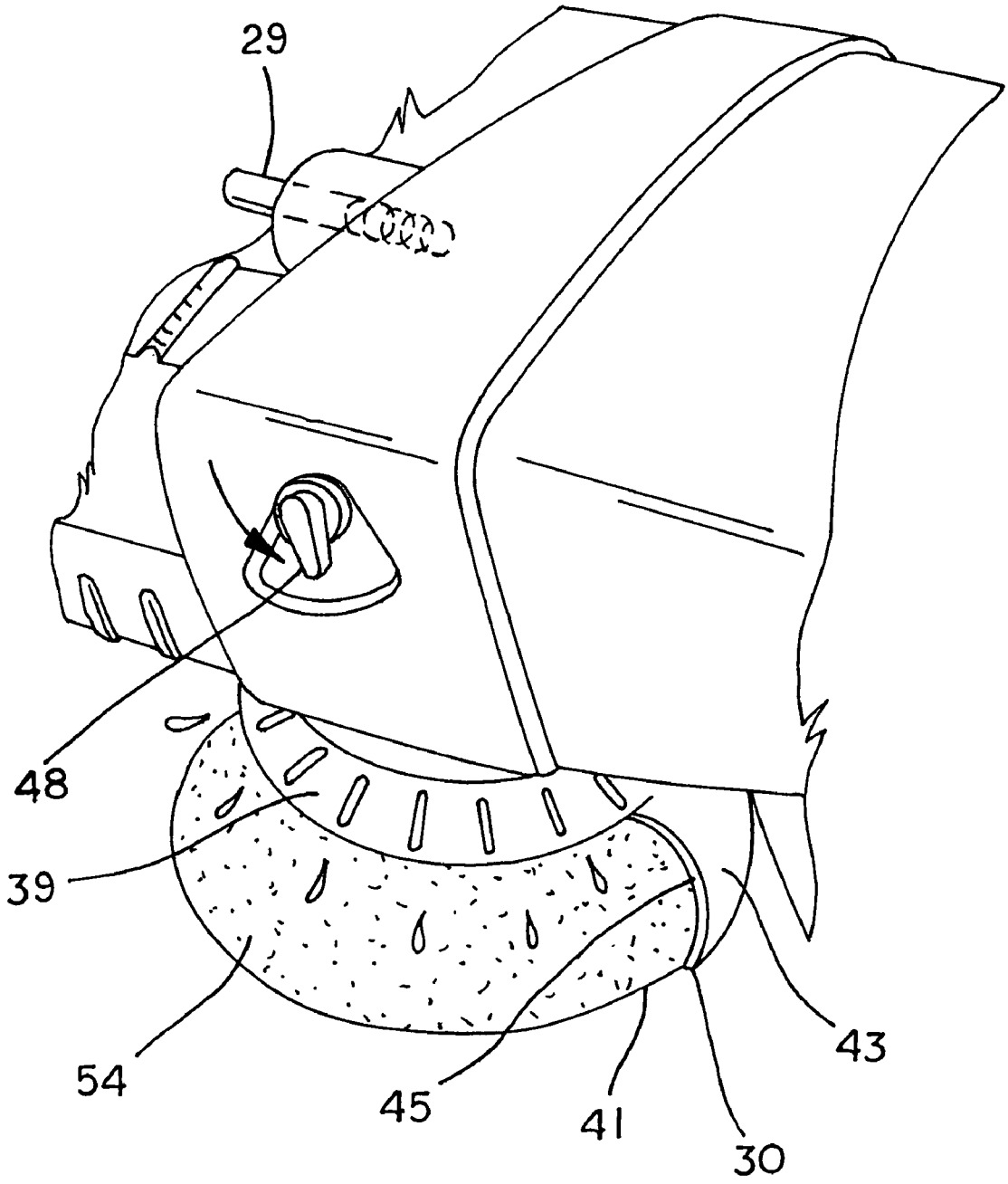
FIG. 6 is an enlarged fragmentary view in perspective illustrating the second detectable water toy disposed in the second receiving area.
Figure 7:
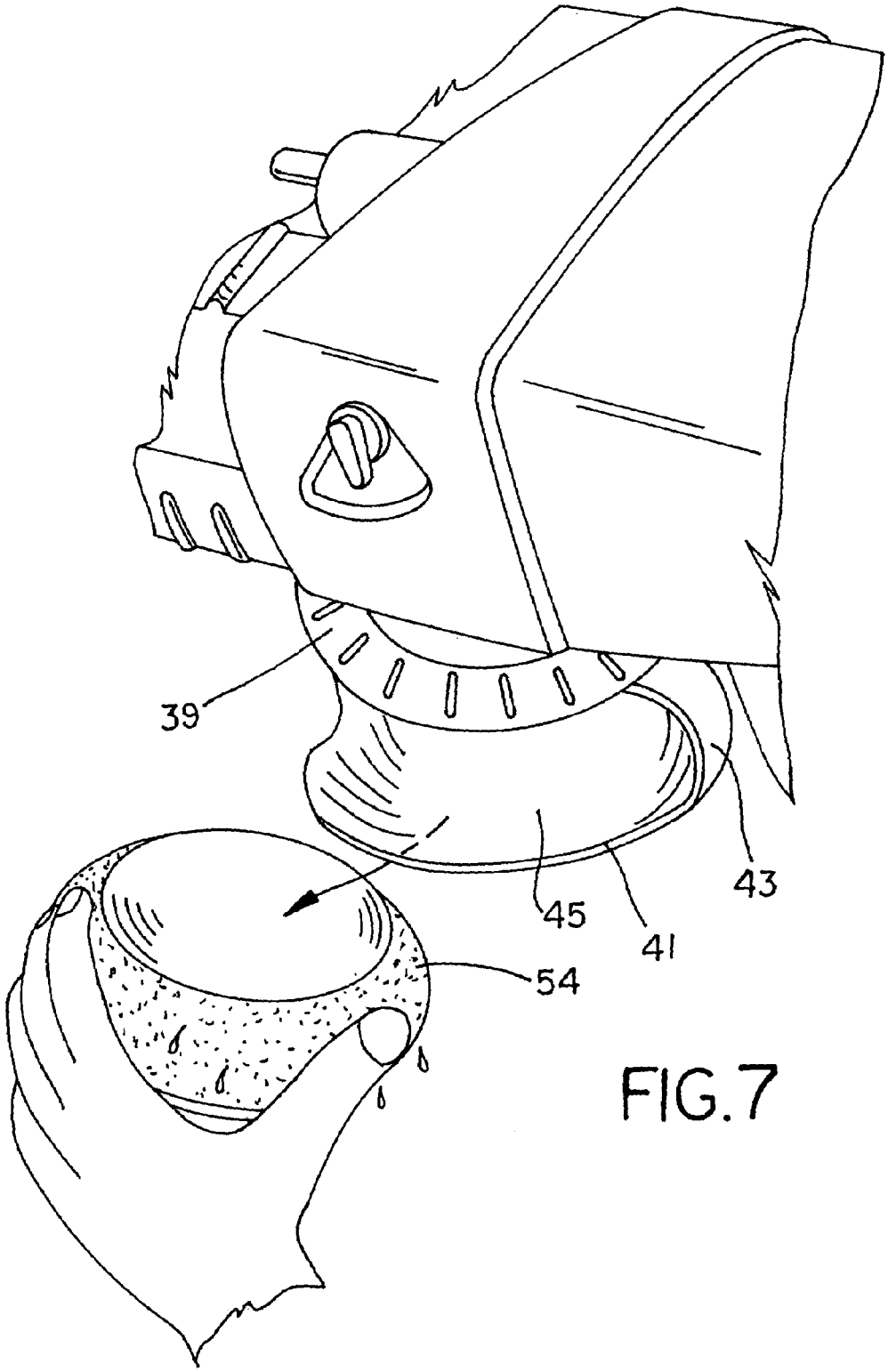
FIG. 7 is an enlarged fragmentary view in perspective similar to FIG. 6 and illustrating the second detachable water toy being removed from the second receiving area.

Referring now to FIGS. 6–7, in accordance with the disclosed example the second receiving area 30 includes a pair of spaced apart panels 39 and 41. The panels 39 and 41 are connected by an arm 43, such that a space 45 is defined between the panels 39 and 41. As can be seen in FIG. 6, when the second water toy 54 is disposed in the second receiving area 30, the second water toy 54 is disposed between the panels 39 and 41. Preferably, the panels 39 and 41 may be curved or otherwise shaped so as to correspond to or generally complement the shape of the second water toy 54.

Figure 8:
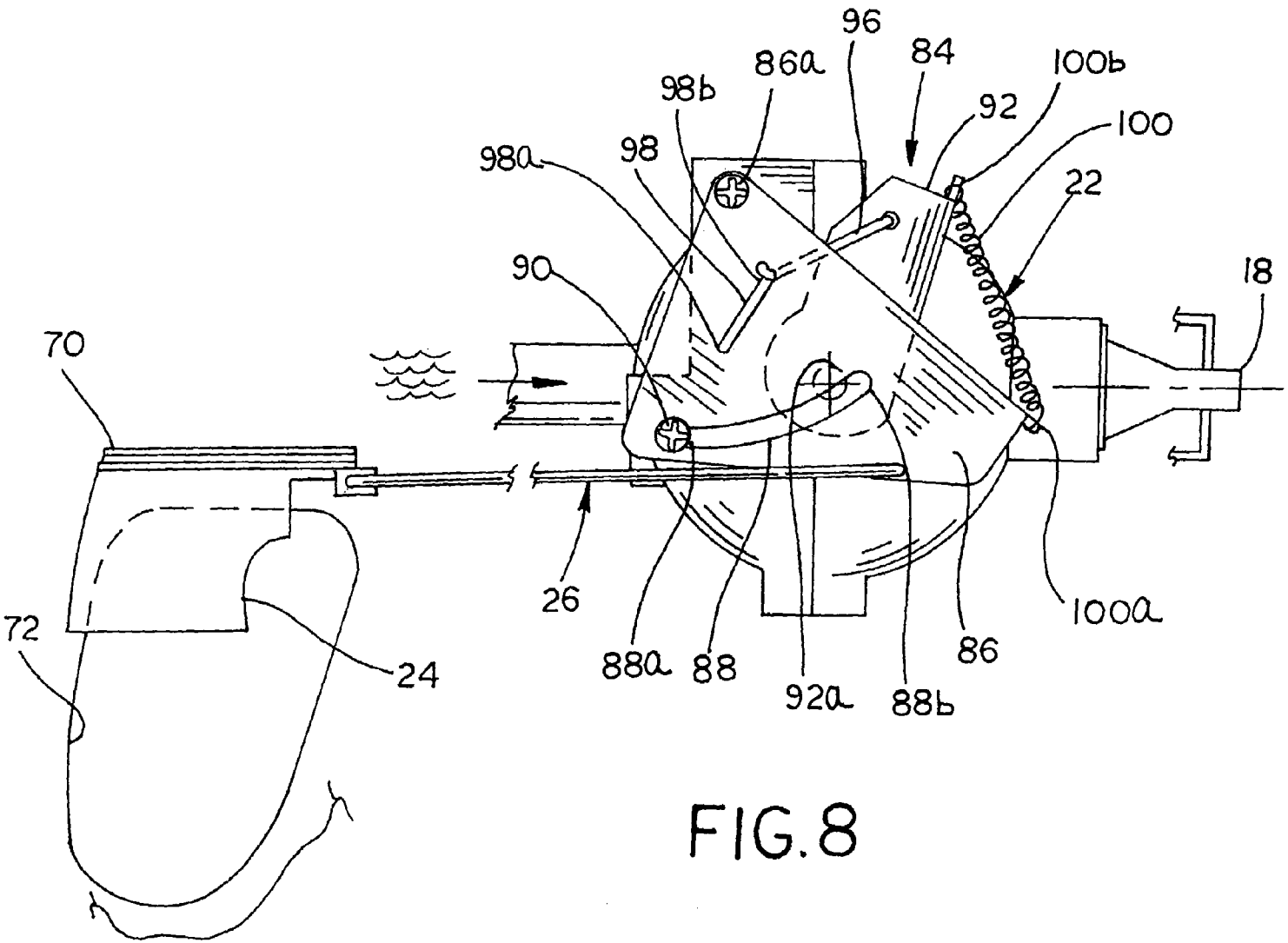
FIG. 8 is an enlarged fragmentary bottom plan view of a trip valve mechanism illustrated in a first position.
Figure 9:
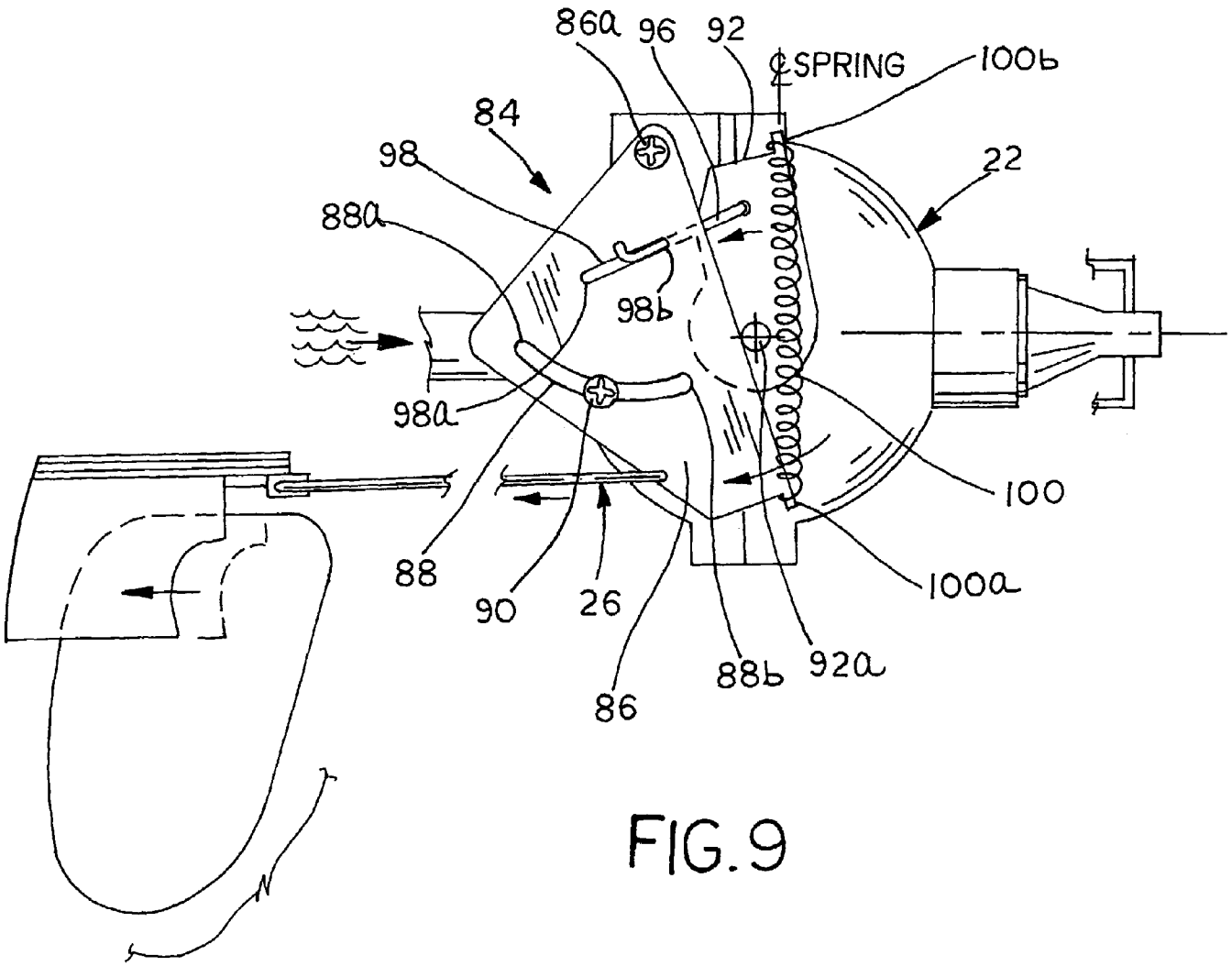
FIG. 9 is an enlarged fragmentary bottom plan view similar to FIG. 8 and illustrating the trip valve mechanism in a second position.
Figure 10:
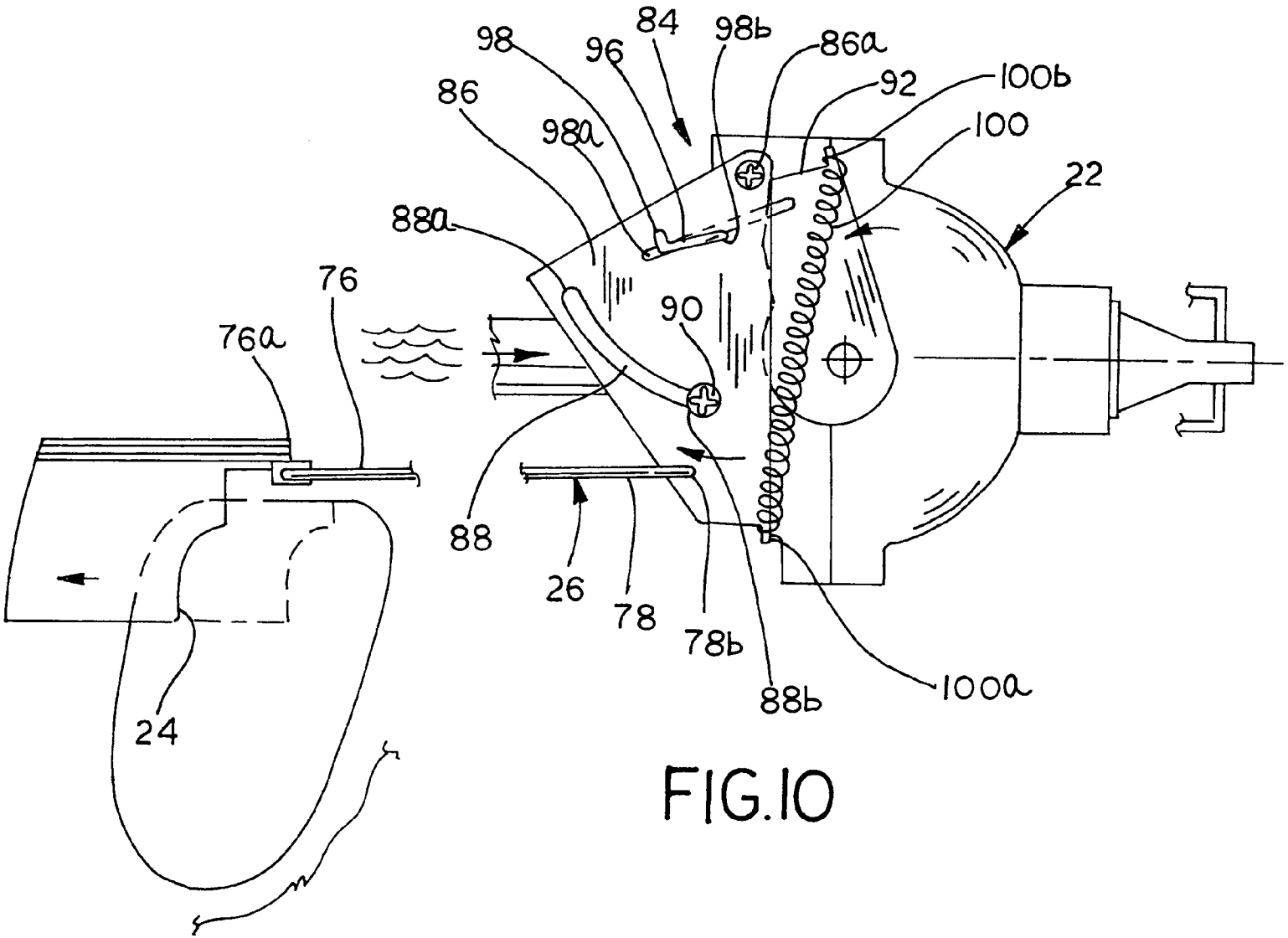
FIG. 10 is an enlarged fragmentary bottom plan view similar to FIGS. 8 and 9 and illustrating the trip valve mechanism in a third position.

Referring now to FIGS. 8, 9, and 10, the valve assembly 22 (the underside of which is shown) may include a trip assembly 84 which is operatively connected to the trigger 24 via the linkage 26. The trip assembly 84 controls the actuation of the valve assembly 22 and enables the user to shoot water as desired. The trip assembly 84 includes a pivot plate 86 which pivots about a pivot point 86*a*. A forward end 78*b* of the rod 78 is attached to the pivot plate 86. The pivot plate 86 includes a slot 88 having a pair of ends 88*a* and 88*b*, and a stop screw 90 is mounted so as to extend through the slot 88. A lever 92 is operatively connected to a conventional rotary valve 94 disposed within the valve assembly 22, and the lever 92 is pivotable about a pivot point 92*a*. The lever 92 is connected to the plate 86 by a link arm 96 which fits within a slot 98 in the pivot plate 86. The slot 98 includes a pair of ends 98*a* and 98*b*. A spring 100 is connected to the pivot plate 86 at 100*a* and to the lever 92 at 100*b*. When the plate 86 and the lever 92 are positioned as shown in FIG. 8, the rotary valve 94 is off, such that no water will be ejected from the outlet nozzle 18.

Referring now to FIG. 9, when the trigger 24 is retracted (to the left when viewing FIG. 9) from an initial position shown in FIG. 8 to an intermediate position of FIG. 9, the rod 78 pulls on the pivot plate 86, causing the pivot plate 86 to shift in a generally clockwise direction about the pivot 86*a*. In the process, the end 88*b* of the link arm 96 pulls the lever 92, causing the lever 92 to rotate in a generally counterclockwise direction about the pivot point 92*a*, thus opening the rotary valve 94 such that water may be ejected from the nozzle 18.

Referring now to FIG. 10, when the trigger 24 is displaced sufficiently to the left to a fully retracted position as shown in FIG. 10, the pivot plate 86 may pivot sufficiently far that the stop screw 90 comes into contact with the end 88*b* of the slot 88. Eventually, the spring with 100 will pass the pivot 92*a*, which causes the spring 100 to apply a further biasing force to the lever 92, thereby causing the lever 92 to rotate more rapidly in the counter-clockwise direction about the pivot point 92*a*. The link arm 96 may come into contact with the end 98*a* of the slot 98, thus limiting the rotational movement of the lever 92. The valve 94 may be arranged such that the valve is turned fully on when the lever 92 is rotated far enough. Releasing the trigger 24 will permit the trip assembly 84 to return to the position of FIG. 8.

Consequently, in accordance with the disclosed example, the trip assembly 84 serves to define three possible positions for the rotary valve 94. These positions include a first position shown in FIG. 8 (in which the rotary valve 94 is closed), a second position shown in FIG. 9 (in which the rotary valve 94 is in a partially open position), and a third position shown in FIG. 10 (in which the rotary valve 94 is in a fully open position). Other configurations may be chosen, including by way of example rather than limitation, a closed position and one or more open positions for the rotary valve 94. As a still further alternative, the toy water gun 12 may simply be provided with a more conventional valve at the outlet nozzle 18 of the type that is commonly employed in toy water guns. Additional description of the valve 22 and/or the trip assembly 84 can be found in U.S. Pat. No. 6,631,830, entitled "Snap Action Ball Valve Assembly and Liquid Dispenser Using the Same", the entire disclosure of which is incorporated herein by reference.

Figure 11:
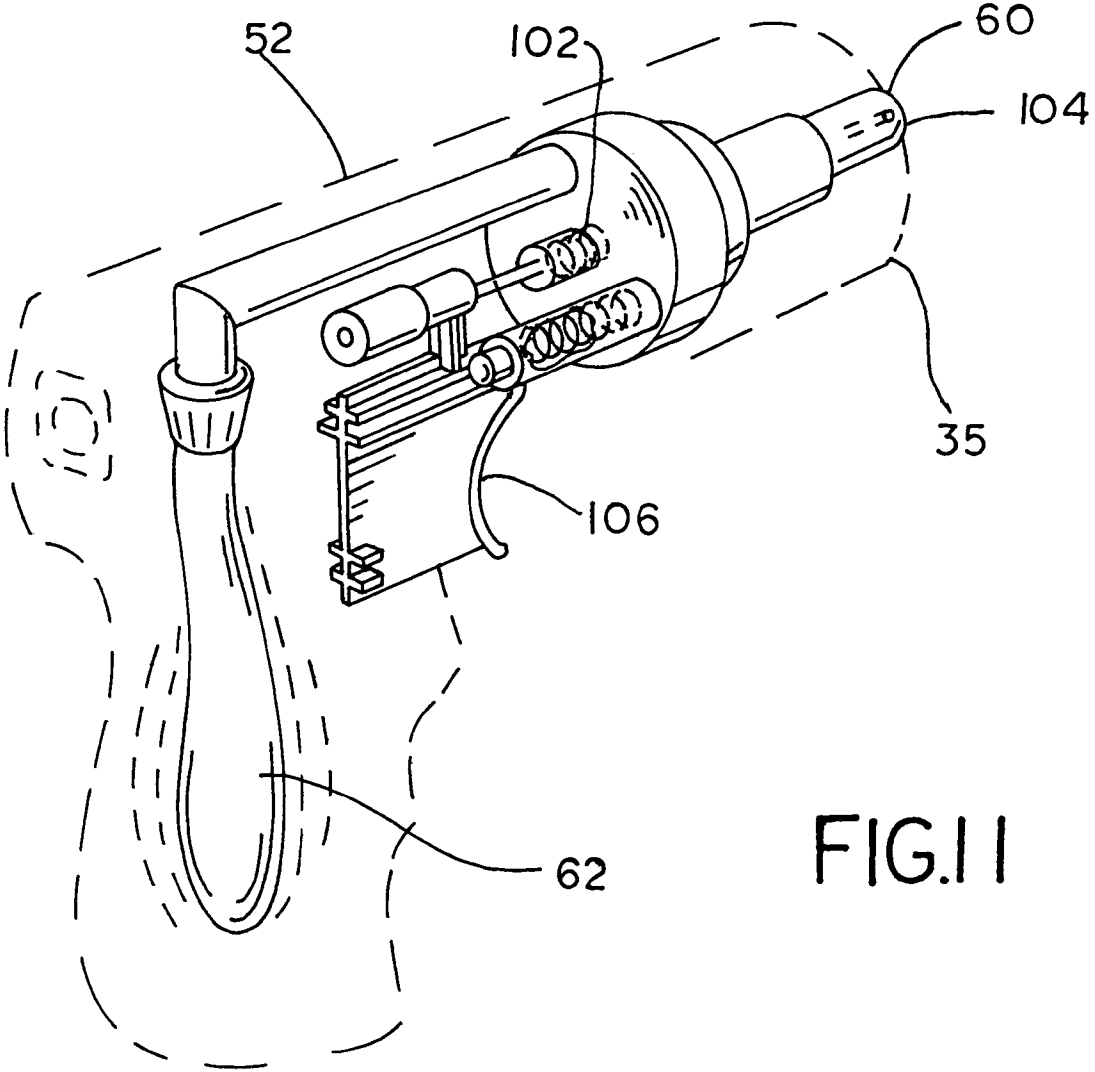
FIG. 11 is an enlarged elevational view, partly in cutaway, of the first detachable water toy.
Figure 12:
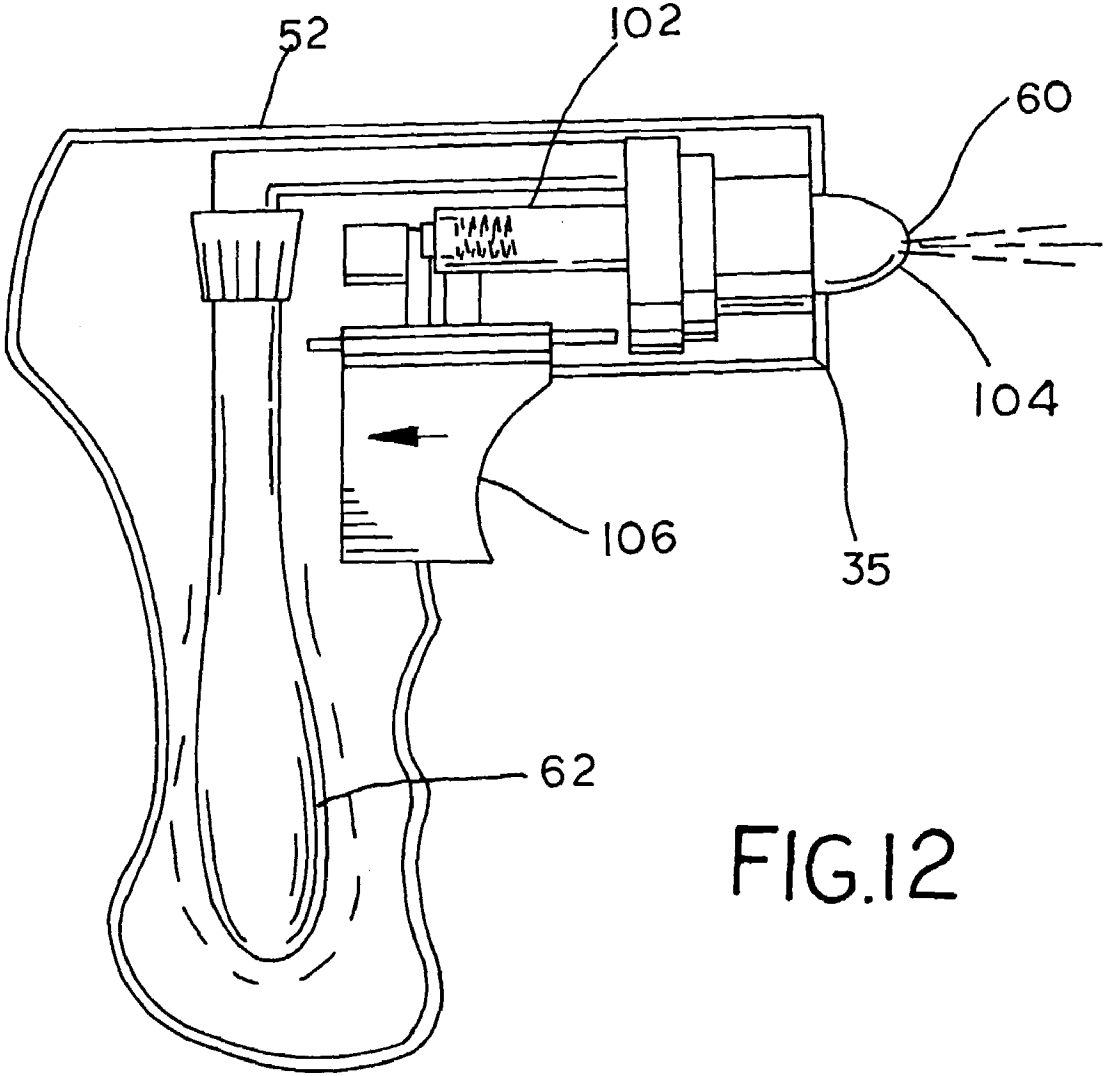
FIG. 12 is an enlarged fragmentary view in perspective of the interior of the first detachable water toy.

Referring now to FIGS. 11 and 12, the first detachable water toy 52 is shown therein in greater detail. In accordance with the disclosed example, the first water toy 52 preferably includes a spring-loaded check valve 102 disposed generally adjacent to the forward end 35 of the water toy 52. It will be understood that a tip 104 of the nozzle 60 may be placed in flow communication with the output port 34 of the first receiving area 28 such that water flowing through the conduit 32 may be routed into the reservoir 62 of the water toy 52 upon operation of the rotary valve 36 as will be explained in greater detail below. It will further be understood that the tip 104 reciprocates to the left and the right when viewing FIG. 12, such that the check valve 102 can be opened or closed. When tip 104 is shifted toward the left when viewing FIG. 12, such as when the water toy 52 is disposed in the receiving area 28, the check valve 102 is open such that water under pressure may flow into the reservoir 60. Alternatively, the check valve 102 may be arranged such that the check valve 102 opens in response to the pressure when the reservoir 16 is pressurized and the valve 36 is opened to route pressurized water through the port 34 and into the nozzle 60 and hence into the reservoir 62. A trigger 106 is provided and is operatively connected to the check valve 102, such that the water toy 52 may be operated by opening and closing the check valve 102 using the trigger 106.

Figure 13:
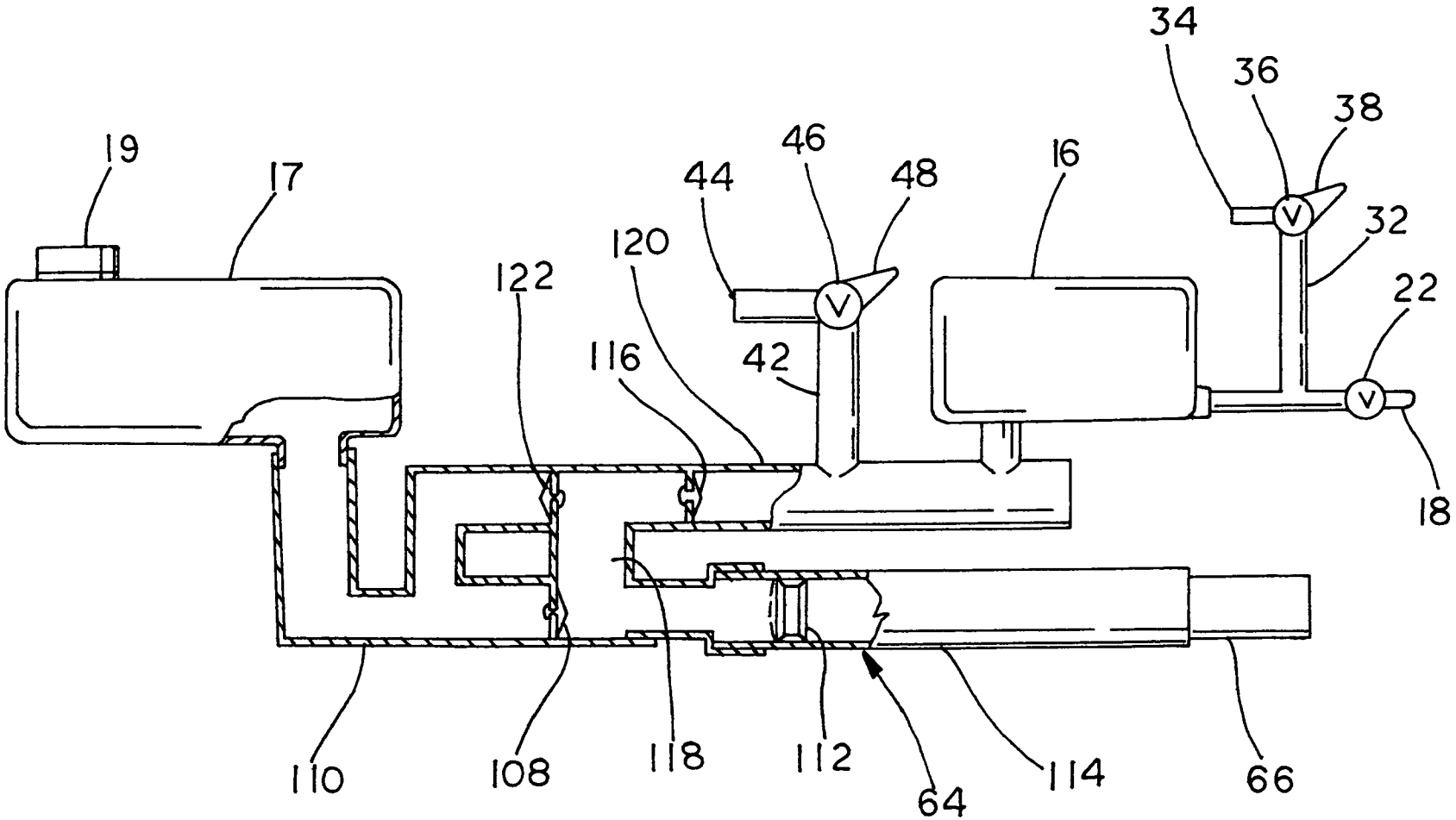
FIG. 13 is an enlarged fragmentary cross-sectional view illustrating various elements of the reservoir pressurizing mechanism.

Referring now to FIG. 13, the fluid flow path of the primary water gun 12 will be described in greater detail. The fill cap 19 of the second reservoir 17 may be removed such that water or any other suitable fluid may be placed in the second reservoir 17. The second reservoir 17 is connected to a one-way valve 108 by a conduit 110. The pressurizing mechanism 64 includes a plunger 112, which reciprocates within a tubular conduit 114 upon reciprocal operation of the handle 66. Another one-way valve 116 is provided, and is connected to the first one-way valve 108 by a conduit 118. The one-way valve 116 is also connected to the reservoir 16 by a conduit 120. An overpressure valve 122 is preferably provided, with the overpressure valve 122 in flow communication with both the conduits 110 and 118. The overpressure valve limits the maximum pressure within the reservoir 16.

To operate the pressurizing mechanism 64, a user (not shown), grips the handle 66 and slides the handle 66 generally to the right when viewing FIG. 13 to create a vacuum in the conduit 114. The vacuum acting on the one-way valve 108 opens the valve 108 and allows fluid to flow from the reservoir 17 into the conduit 114. When the handle 66 is pushed to the left, the valve 108 closes and the water contained within the conduit 114 is forced through the conduit 118, through the one-way valve 116, and into the reservoir 16 via the conduit 120. Consequently, the internal conduits, including the conduit 120 leading to the reservoir 16 as well as the conduits 32 and 42 leading to the first and second receiving areas 28, 30, respectively, all get filled with water. Additional water may be pumped into the reservoir 16 upon repeated actuation of the handle 66, such that any air within the reservoir 16 applies pressure to all of the water contained in the pressurized part of the system. The overpressure valve 122 prevents too much pressure buildup in the pressurizing mechanism 64 by routing water back into the conduit 110 and hence back into the reservoir 17.

When a user desires to operate the toy water gun system 10, the user may choose between the three water toys shown. Using the pressurizing mechanism 64 as described above, the appropriate pressure head is applied by reciprocating the handle 66 and forcing water into the system until the reservoir 16 is suitably pressurized. In the event the user wishes to eject water from the outlet nozzle 18 of the primary water gun 12, the user simply actuates the trigger 24 as described above.

The user may also desire to detach and use a selected one of the detachable water toys 52 and/or 54. In a preferred mode of operation, the user will first suitably pressurize the reservoir 16 using the pressurizing mechanism 64 as described above. In the event the user desires to operate the second water toy 54, the user manipulates the spring-loaded valve 46 disposed generally adjacent to the second receiving area 30, which allows pressurized water contained within the conduit 42 to flow out of the output port 44 and into the second water toy 54, thus soaking the second water toy 54. As can be seen in FIG. 7, the user then releases the handle 48 of the valve 46, such that the rotary spring 50 returns the valve 46 to a closed position. The user then removes the soaked second detachable water toy 54 from the second receiving area 30, and may then throw the second detachable water toy 54 or otherwise use the toy in any desired manner.

When the user desires to use the first water toy 52, the first detachable water toy 52 should be placed in the first receiving area 28, with the plunger 29 engaging the recess 31 on the rearward end 33 of the first detachable water toy 52, and with the forward end 35 disposed in the recess 37. Accordingly, the plunger 29 serves to bias the second detachable water toy 52 forwardly, such that the forward end 35 is pressed into the recess 37 so that the toy 54 may be suitably retained in the first receiving area 28. It will be noted that the nozzle 60 of the first detachable water toy 52 will be in flow communication with the output port 34 of the conduit 32. Further, when the forward end 35 of the first detachable water toy 52 is in contact with the recess 37 under the biasing force of the plunger 29, the check valve will permit flow communication between the output port 34, the nozzle 60, and the reservoir 62. When the user desires to fill the reservoir 62, assuming the reservoir 16 has been suitably pressurized using the pressurizing mechanism 64 as described above, the user simply manipulates the handle 38 so as to open the valve 36, which routes pressurized water through the output port 34 of the first receiving area 28, through the nozzle 60 of the first detachable water toy 52, and into the reservoir 62 contained within the first detachable water toy 52. When a quantity of pressurized water is contained within the reservoir 62, the user closes the rotary valve 36 by simply releasing the handle 38. The first detachable water toy 52 is then ready to be removed from the first receiving area 28 in order to be used.

When the user desires to use the first detachable water toy 52, the user may rotate the first detachable water toy 52 from the position shown in FIGS. 3 and 4 toward the position illustrated in FIG. 5, such that the user can grasp a handle portion of the first detachable water toy 52. The first detachable water toy 52 may then be pushed forwardly by the user so as to disengage the plunger 29 from the recess 31, thus permitting the water toy 52 to be removed from the first receiving area 28 by pulling the rearward end of the water toy 52 away from the housing 14. The water toy 52 may then be operated using the trigger 106 which opens the check valve 102, such that pressurized water contained within the reservoir 62 may be suitably ejected from the nozzle 60.

It will be understood that the toy water gun system 10 may include additional or fewer detachable water toys as desired. The number and location of the internal conduits may be readily adaptable to route pressurized water to the desired number of detachable water toys. It will also be understood that the water toy 52 may be suitably adapted to be fired while still attached to the primary water gun 12 at the first receiving station 28. For example, the water toy 52 may include one port for filling the reservoir inside the water toy 52, and a separate port or outlet nozzle to be used when firing the water toy 52 in a conventional manner.

The teachings of the present invention may also be applied to an air-operated toy gun system, in which a primary toy gun and/or one or more of the detachable toys are air-operated and are arranged to shoot, by way of example rather than limitation, soft foam projectiles using a blast of compressed air. In the event the toy gun system is arranged for air operation, each of the toy guns (i.e., the primary toy gun, the first detachable toy gun and the second detachable toy gun) each may be provided with a suitable launching station of type that receives and holds a soft foam projectile in preparation for launch. Further, one or more of the toy guns may include an air tank that may be pressurized to hold compressed air for launching the projectiles. One example of a toy gun having an air tank that may be pressurized to launch foam projectiles is illustrated and described in U.S. Pat. No. 5,515,837, entitled "Safety Nozzle for Multi-Shot Projectile Shooting Air Gun" which issued on May 14, 1996, and which is hereby expressly incorporated by reference herein in its entirety.

When such a toy gun system is provided, it will be understood that the above-described internal conduits will route pressurized air to the appropriate output ports at their corresponding receiving areas, such that an air-operated detachable toy gun disposed in an appropriate one of the receiving areas may be pressurized via the output port at that receiving area using a corresponding one of the valves. Additionally, and air-operated toy gun disposed in one of the receiving areas may be arranged to be fired while still disposed in one of the receiving areas. In such an exemplary form, the air operated toy gun may be pressurized through and inlet port on the toy gun, and may include a second outlet port disposed adjacent a launching station of the foam projectile. A one way valve responsive to air pressure may be provided such that the detachable air-operated toy gun may be automatically pressurized when the primary toy gun is pressurized. The projectile of the detachable toy gun may be launched using a trigger attached to the detachable toy gun, or by actuating the trigger on the primary toy gun.

The preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. An applicator for attaching fasteners to body tissue comprising:

a distal portion having an elongate outer tube, a connecting end and a terminal end;

a proximal portion having a handle and an actuator, the proximal portion being attached to the connecting end of the distal portion; and a rotator cooperating with the actuator and including a longitudinal groove extending along at least a portion of the length of the rotator, the groove configured to receive a portion of a fastener, wherein the rotator resides within and extends substantially the length of the outer tube such that actuation of the actuator rotates the fastener relative to the outer tube.

2. The applicator of claim 1 further comprising:

a lock/clip indicator for engaging a plurality of fasteners; and a load spring for applying longitudinal forces against the lock/clip indicator.

3. The applicator of claim 2, wherein the lock/clip indicator is configured to prevent actuation of the actuator upon discharge of the plurality of fasteners from the applicator.

4. The applicator of claim 1 further comprising:

a thread form contained in an interior of the terminal end adapted to engage the plurality of fasteners.

5. The applicator of claim 4, wherein the thread form is an interlock spring fixedly retained in the interior of the terminal end.

6. The applicator of claim 1 further comprising:

a nose piece attached to the terminal end, the nose piece having structure projecting perpendicularly toward a longitudinal axis of the outer tube and adapted to engage the plurality of fasteners.

7. The applicator of claim 1, wherein the distal portion and the proximal portion are releasably secured together.

8. The applicator of claim 7, wherein the distal portion is disposable and the proximal portion is reusable.

9. The applicator of claim 1, wherein the actuator includes:

a lever having a first end and a second end, the lever pivotally attached about a midpoint to the handle;

the first end of the lever for gripping by hand;

a lead screw rotatably attached to interior of the handle;

a nut driver, the second end of the lever pivotally attached to the nut driver, the nut driver for traveling along the lead screw, thereby turning the lead screw; and the lead screw attached to the rotator so that as the lever is depressed by hand the nut driver will travel along the lead screw towards the rotator thereby turning the rotator in the process.

10. The applicator of claim 9, wherein the lead screw is a high helix lead screw.

11. The applicator of claim 9, wherein the lever has a midsection extension.

12. The applicator of claim 11, further comprising gear teeth formed within the interior of the handle.

13. The applicator of claim 12, further comprising a spring loaded pawl pivotally attached to the midsection extension and adapted to engage the gear teeth.

14. The applicator of claim 1, wherein the actuator includes:

a lever having a first end, a midsection, and a second end, the first end pivotally attached to the handle, the midsection for gripping by hand;

a lead screw rotatably attached to an interior of the handle;

a nut driver, the second end pivotally attached to the nut driver, the nut driver for traveling along the lead screw, thereby turning the lead screw; and means for the lead screw to releasably engage the rotator so that as the lever is depressed by hand, the nut driver will travel along the lead screw toward the rotator thereby turning the rotator in the process and so that when the lever is returned to its undepressed position, the lead screw will rotate in the reverse direction and independently of the rotator which remains stationary.

15. The applicator of claim 14, wherein the lead screw is a high helix lead screw.

16. The applicator of claim 14, wherein the releasable engagement means is a ratchet mechanism.

17. The applicator of claim 14, wherein the lever has a mid-section extension, formed in the mid-section extension are a plurality of teeth.

18. The application of claim 17, further comprising a latch pawl cooperating with the teeth to prohibit the lever from backstroking until it has been completely depressed.

19. A toy water gun system comprising:

a primary water gun having a housing, a reservoir, an outlet nozzle in flow communication with the reservoir, an actuating trigger, and an outlet valve disposed adjacent the outlet nozzle and responsive to actuation of the trigger, the primary water gun adapted to discharge an output stream of water through the outlet nozzle in response to actuation of the trigger;

the outlet valve including a trip mechanism shiftable between a first position in which flow through the outlet nozzle is prevented, a second position in which flow through the outlet nozzle is permitted, and a third position different from the first position in which flow through the outlet nozzle is prevented, the trip mechanism shiftable between the first, second and third positions in response to movement of the trigger between a first position, a second position, and a third position, respectively;

the housing of the primary water gun further including a first receiving area and a second receiving area, each of the first and second receiving areas having an output port, the output port of the first receiving area in flow communication with the reservoir via a first conduit, the output port of the second receiving area in flow communication with the reservoir via a second conduit;

a first valve positioned to control flow through the first conduit;

a second valve positioned to control flow through the second conduit;

a first detachable water toy removably attached to the first receiving area, first detachable water toy including an expandable bladder, a nozzle in communication with the bladder, ,and an actuating trigger, the first detachable water toy adapted to discharge an output stream of water through the nozzle in response to actuation of the trigger, the bladder of the first detachable water toy arranged to receive water through the nozzle from the reservoir of the primary water gun via the output port of the first receiving area in response to operation of the first valve;

a spring-loaded plunger positioned to bias at least a portion of the first detachable water toy into engagement with the housing;

a second detachable water toy removably attached to the second receiving area, the second detachable water toy arranged to receive water from the reservoir via the output port of the second receiving area in response to operation of the second valve;

wherein the first and second detachable water toys are selectively removable from the primary water gun for use, wherein the second detachable water toy is includes a deformable sponge, and wherein the second receiving area includes a pair of spaced apart panels sized and shaped to releasably retain the second detachable water toy in the second receiving area.

20. The toy water gun of claim 19, wherein the second detachable water toy comprises a absorbent sponge and the second receiving area comprises at least one panel arranged to releasably retain the second detachable water toy in the second receiving area, and wherein the first detachable water toy includes a spring-loaded check valve, the spring-loaded check valve arranged to shift to an open position when the first detachable water toy is disposed in the first receiving area to thereby permit flow communication between the output port and the expandable bladder, the spring-loaded check valve further arranged to shift to a closed position when the first detachable water toy is removed from the first receiving area.

21. A toy gun system comprising:

a primary toy gun having a housing, a pressurizable reservoir, a launch station in flow communication with the reservoir, an actuating trigger, and an actuator arranged to release pressure from the reservoir through the launch station, the launch station adapted to hold and release a foam projectile in response to actuation of the actuator;

the housing of the primary toy gun further including a receiving area, the receiving area having an output port, the output port of the receiving area in flow communication with the reservoir via a conduit;

a detachable toy gun removably attached to the first receiving area, the detachable toy gun including a pressurizable reservoir, a launch station in flow communication with the reservoir, and an actuator arranged to release pressure from the reservoir through the launch station, the launch station adapted to hold and release a foam projectile in response to actuation of the actuator, the detachable toy gun including an input port arranged to route pressure from the output port of the receiving area to the reservoir of the detachable toy gun;

a spring-loaded plunger positioned to bias at least a portion of the detachable toy into engagement with the housing to facilitate flow communication between the reservoir of the primary toy gun and the detachable toy gun when the detachable toy gun is in the receiving area; and wherein the detachable toy is selectively operable to launch the foam projectile when the detachable toy is in the receiving area and when the detachable toy is removed from the receiving area.

22. The toy gun system of claim 21, including a valve positioned to control flow into the input port of the detachable toy gun.

23. The toy gun system of claim 21, including a one-way valve positioned to control flow through the conduit.

24. The toy gun system of claim 23, wherein the one-way valve opens in response to an increase in air pressure in the reservoir of the primary toy gun.

* * * * *

UNITED STATES PATENT AND TRADEMARK OFFICE

CERTIFICATE OF CORRECTION

PATENT NO. : 7,185,787 B2
APPLICATION NO. : 10/775427
DATED : March 6, 2007
INVENTOR(S) : Robert L. Brown et al.

It is certified that error appears in the above-identified patent and that said Letters Patent is hereby corrected as shown below:

At Column 12, line 53, “bladder, ,and” should be -- bladder, and--.

At Column 13, line 6, “toy is includes” should be -- toy includes --.

At Column 13, line 12, “a absorbent” should be -- an absorbent --.

Signed and Sealed this

Seventh Day of October, 2008

JON W. DUDAS
*Director of the United States Patent and Trademark Office*

UNITED STATES PATENT AND TRADEMARK OFFICE

CERTIFICATE OF CORRECTION

PATENT NO. : 7,185,787 B2
APPLICATION NO. : 10/775427
DATED : March 6, 2007
INVENTOR(S) : Robert L. Brown et al.

It is certified that error appears in the above-identified patent and that said Letters Patent is hereby corrected as shown below:

At Columns 11 and 12, "claims 1-18," should be the following claims.

-- 1. A toy water gun system comprising:

a primary water gun having a housing, a pressurizable reservoir, an outlet nozzle in flow communication with the reservoir, and an actuating trigger, the primary toy water gun adapted to discharge an output stream of water through the outlet nozzle in response to actuation of the trigger;

the housing of the primary water gun further including a first receiving area and a second receiving area, each of the first and second receiving areas having an output port, the output port of the first receiving area in flow communication with the reservoir via a first conduit, the output port of the second receiving area in flow communication with the reservoir via a second conduit;

a first valve positioned to control flow through the first conduit;

a second valve positioned to control flow through the second conduit;

a first detachable water toy sized for mounting to the housing at the first receiving area, the first detachable water toy arranged to receive water from the reservoir via the output port of the first receiving area in response to operation of the first valve; and Signed and Sealed this Twenty-fourth Day of February, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,185,787 B2
APPLICATION NO. : 10/775427
DATED : March 6, 2007
INVENTOR(S) : Robert L. Brown et al.

It is certified that error appears in the above-identified patent and that said Letters Patent is hereby corrected as shown below:

Column 11, line 2 - Column 12, line 20, "claims 1-18," should be the following claims.

-- 1. A toy water gun system comprising:

a primary water gun having a housing, a pressurizable reservoir, an outlet nozzle in flow communication with the reservoir, and an actuating trigger, the primary toy water gun adapted to discharge an output stream of water through the outlet nozzle in response to actuation of the trigger;

the housing of the primary water gun further including a first receiving area and a second receiving area, each of the first and second receiving areas having an output port, the output port of the first receiving area in flow communication with the reservoir via a first conduit, the output port of the second receiving area in flow communication with the reservoir via a second conduit;

a first valve positioned to control flow through the first conduit;

a second valve positioned to control flow through the second conduit;

a first detachable water toy sized for mounting to the housing at the first receiving area, the first detachable water toy arranged to receive water from the reservoir via the output port of the first receiving area in response to operation of the first valve; and a second detachable water toy sized for mounting to the housing at the second receiving area, the second detachable water toy arranged to receive water from the reservoir via the output port of the second receiving area in response to operation of the second valve;

wherein the first and second detachable water toys are selectively removable from the primary water gun for use.

2. The toy water gun system of claim 1, wherein the first detachable water toy includes a pressurizable reservoir, an outlet nozzle in communication with the reservoir, and an actuating trigger, the first detachable water toy adapted to discharge an output stream of water through the outlet nozzle of the first detachable water toy in response to actuation of the trigger of the first detachable water toy.

UNITED STATES PATENT AND TRADEMARK OFFICE

CERTIFICATE OF CORRECTION

PATENT NO. : 7,185,787 B2
APPLICATION NO. : 10/775427
DATED : March 6, 2007
INVENTOR(S) : Robert L. Brown et al.

It is certified that error appears in the above-identified patent and that said Letters Patent is hereby corrected as shown below:

3. The toy water gun system of claim 1, wherein the first receiving area includes a spring-loaded plunger positioned to releasably retained the first detachable water toy in the first receiving area.

4. The toy water gun system of claim 3, wherein the first detachable water toy includes an inlet port positioned to receive water from the output port of the first receiving area, and wherein the spring-loaded plunger is adapted to maintain the inlet port of the first water toy in flow communication with the output port of the first receiving area when the first detectable water toy is disposed in the first receiving area.

5. The toy water gun system of claim 1, wherein the second detachable water toy includes a sponge.

6. The toy water gun system of claim 1, wherein the sponge is throwable.

7. The toy water gun system of claim 5, wherein the second receiving area includes a first panel disposed adjacent the output port of the first receiving area and a second panel spaced away form the first panel, the first and second panels cooperating to releasably retain the second detachable water toy in the second receiving area.

8. The toy water gun system of claim 7, wherein the first and second panels are shaped to correspond to the shape of the second detachable water toy.

9. The toy water gun system of claim 1, wherein the first and second valves are spring-loaded.

10. The toy water gun system of claim 1, wherein the trigger of the primary water gun is slidably mounted to the housing, and wherein the primary water gun includes a primary valve disposed adjacent the outlet nozzle, the primary valve operatively connected to trigger by a connecting rod.

UNITED STATES PATENT AND TRADEMARK OFFICE

CERTIFICATE OF CORRECTION

PATENT NO. : 7,185,787 B2
APPLICATION NO. : 10/775427
DATED : March 6, 2007
INVENTOR(S) : Robert L. Brown et al.

It is certified that error appears in the above-identified patent and that said Letters Patent is hereby corrected as shown below:

11. A toy water gun system comprising:

a primary water gun having a housing, a reservoir, an outlet nozzle in flow communication with the reservoir, an actuating trigger, and an outlet valve disposed adjacent the outlet nozzle and responsive to actuation of the trigger, the primary toy water gun adapted to discharge an output stream of water through the outlet nozzle in response to actuation of the trigger;

the housing of the primary water gun further including a first receiving area and a second receiving area, each of the first and second receiving areas having an output port, the output port of the first receiving area in flow communication with the reservoir via a first conduit, the output port of the second receiving area in flow communication with the reservoir via a second conduit;

a first valve positioned to control flow through the first conduit;

a second valve positioned to control flow through the second conduit;

a first detachable water toy removably attached to the first receiving area, first detachable water toy including an expandable bladder, a nozzle in communication with the bladder, and an actuating trigger, the first detachable water toy adapted to discharge an output stream of water through the nozzle in response to actuation of the trigger, the bladder of the first detachable water toy arranged to receive water through the nozzle from the reservoir of the primary water gun via the output port of the first receiving area in response to operation of the first valve; and a second detachable water toy removably attached to the second receiving area, the second detachable water toy arranged to receive water from the reservoir via the output port of the second receiving area in response to operation of the second valve;

wherein the first and second detachable water toys are selectively removable from the primary water gun for use.

UNITED STATES PATENT AND TRADEMARK OFFICE

CERTIFICATE OF CORRECTION

PATENT NO. : 7,185,787 B2
APPLICATION NO. : 10/775427
DATED : March 6, 2007
INVENTOR(S) : Robert L. Brown et al.

It is certified that error appears in the above-identified patent and that said Letters Patent is hereby corrected as shown below:

12. The toy water gun system of claim 11, wherein the first receiving area includes a spring-loaded plunger positioned to bias the first detachable water toy into engagement with a portion of the housing.

13. The toy water gun system of claim 11, including a spring-loaded plunger disposed adjacent the first receiving area, the spring-loaded plunger positioned to maintain the nozzle of the first detachable water toy in flow communication with the outlet port of the first receiving area when the first detachable water toy is disposed in the first receiving area.

14. The toy water gun system of claim 11, wherein the second detachable water toy is includes a deformable sponge, and wherein the second receiving area includes a pair of spaced apart panels sized and shaped to releasably retain the second detachable water toy in the second receiving area.

15. The toy water gun system of claim 14, wherein the first and second panels are shaped to correspond to the shape of the second detachable water toy.

16. The toy water gun system of claim 11, wherein the first and second valves are spring-loaded.

17. The toy water gun system of claim 11, wherein the primary valve includes a trip valve operatively connected to the trigger, the trip valve including a spring-loaded pivot plate arranged to close the primary valve.

UNITED STATES PATENT AND TRADEMARK OFFICE

CERTIFICATE OF CORRECTION

PATENT NO. : 7,185,787 B2
APPLICATION NO. : 10/775427
DATED : March 6, 2007
INVENTOR(S) : Robert L. Brown et al.

It is certified that error appears in the above-identified patent and that said Letters Patent is hereby corrected as shown below:

18. The toy water gun of claim 11, wherein the primary water totally includes a spring-loaded plunger disposed adjacent the first receiving area and arrange two pious at least a portion of the first detachable water totally into engagement with a portion of the housing when the first detachable water toy is disposed in the first receiving area, and wherein the first detachable water toy includes a spring-loaded check valve, the spring-loaded check valve arranged to shift to an open position when the first detachable water toy is disposed in the first receiving area to thereby permit flow communication between the output port and the expandable bladder, the spring-loaded check out further arranged to shift to a closed position when the first detachable water toy is removed from the first receiving area. --

This certificate supersedes the Certificate of Correction issued February 24, 2009.

Signed and Sealed this

Seventeenth Day of March, 2009

John Doll

JOHN DOLL
*Acting Director of the United States Patent and Trademark Office*